US005850643A

United States Patent [19]

Brumfield

[11] Patent Number: 5,850,643

[45] Date of Patent: Dec. 22, 1998

[54] COMFORT SYSTEM FOR AIRCRAFT

[76] Inventor: John David Brumfield, 351 Walnut St., Hamlin, W. Va. 25523-1405

[21] Appl. No.: 8,058

[22] Filed: Jan. 16, 1998

Related U.S. Application Data

[63] Continuation-in-part of Ser. No. 831,053, Apr. 1, 1997, abandoned.

[51] Int. Cl.[6] ..... A47G 9/06; A47G 9/00

[52] U.S. Cl. ..... 5/419; 5/485; 383/4

[58] Field of Search ..... 5/485, 500, 502, 5/419, 417, 644, 420; 383/4; 428/81, 82

[56] References Cited

U.S. PATENT DOCUMENTS

| | | | |
|---|---|---|---|
| 4,097,944 | 7/1978 | Yulish | 5/419 |
| 4,116,702 | 9/1978 | Rohringer et al. | 106/190 |
| 4,222,926 | 9/1980 | Mizuno et al. | 260/40 R |
| 4,624,320 | 11/1986 | Romaine | 169/50 |
| 4,634,618 | 1/1987 | Greer et al. | 428/81 |
| 5,172,440 | 12/1992 | Ming | 5/485 |
| 5,346,308 | 9/1994 | Buhot et al. | 383/4 |
| 5,454,125 | 10/1995 | Ratkowski | 5/419 |
| 5,457,829 | 10/1995 | Elliott | 5/490 |
| 5,629,071 | 5/1997 | Feldman | 5/419 |
| 5,638,561 | 6/1997 | Sperry et al. | 5/485 |

*Primary Examiner*—Alexander Grosz
*Attorney, Agent, or Firm*—Robert N. Blackmon

[57] ABSTRACT

A comfort system is provided involving a blanket that folds into a pillow configuration, and in a fire retardant version is useful as an aircraft comfort system. The aircraft comfort systems involves a fire retardant blanket that folds into a pillow configuration. The comfort system provides reduced weight and reduced storage volume consumption for aircraft while providing the flexibility of selectively functioning as a pillow or blanket according to the particular needs of the flying population on any given aircraft. The comfort system has an inflatable pillow element received within an inner pocket which is received within an outer pocket. The pillow element in hidden when the comfort system is in either a folded or unfolded position.

9 Claims, 3 Drawing Sheets

COMFORT SYSTEM FOR AIRCRAFT

BACKGROUND OF THE INVENTION

This is a continuation in part application of Brumfield 08/831,053 filed Apr. 1, 1997, now abandoned.

1. Field of the Invention

The present invention relates to comfort systems, and more particularly relates to comfort systems having blankets or quilts.

2. Description of the Related Art

Conventional aircraft comfort systems employ a plurality of blankets and a plurality of pillows. Flyers seeking comfort can access the pillows and/or blanket that they desire from the overhead storage compartment. During some flights there may be a demand for a large number of pillows and on other flights there may be large demand for blankets. In order to meet this demand, there are typically an excess of either blankets and/or pillows on any flight because the exact demand of that flight is not known at the time of takeoff. This excess of pillows and/or blankets typically means that these comfort systems typically utilize more than desired levels of overhead storage space and any weight added by these systems is undesired due to the additional fuel required to transport them.

Consequently, there is a need and desire to provide comfort systems for aircraft which require reduced storage space and reduced weight compared to conventional aircraft comfort systems.

SUMMARY OF THE INVENTION

The present invention involves an comfort system involving a blanket that folds into a pillow configuration, and the aircraft comfort systems involves a fire retardant blanket that folds into a pillow configuration. The comfort system of the present invention provides reduced weight and reduced storage volume consumption for aircraft while providing the flexibility of selectively functioning as a pillow or blanket according to the particular needs of the flying population on any given aircraft. Preferably, the comfort system has an inflatable pillow element hidden within a pocket for providing an inflated pillow if desired when the comfort system is in a blanket configuration.

DETAILED DESCRIPTION OF THE INVENTION

Figure 1:
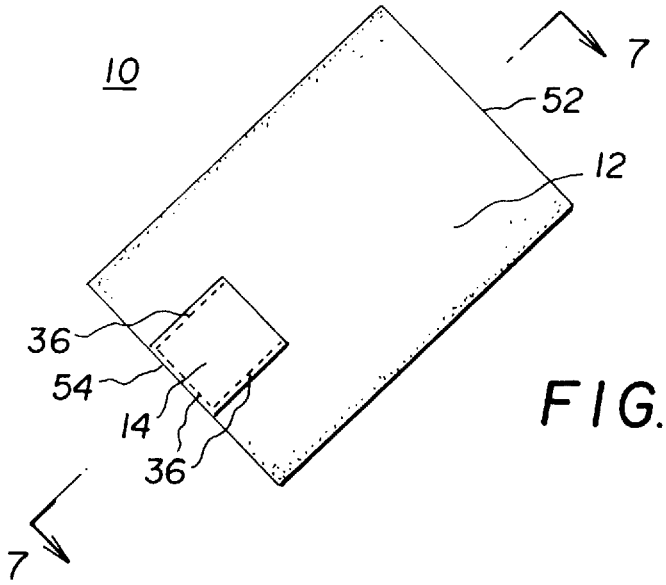
FIG. 1 is a perspective view of the comfort system of the present invention in an unfolded position to function as a blanket.
Figure 5:
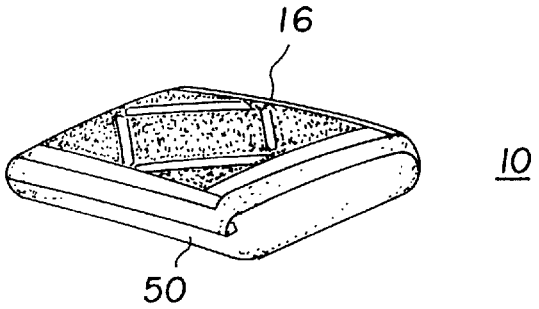
FIG. 5 is a perspective view of the comfort system in a completely folded position to function as a pillow.

As shown in FIG. 1, a comfort system (10) comprises (a) a blanket (12) and (b) a pocket (14), and preferably, as shown in FIG. 5, the pocket has indicia (16) therein. The system (10) is preferably made of a flame resistant and/or fire retardant material suitable for use in aircraft (18).

The blanket (12) preferably is a soft foldable material sufficient to provide a user (20) with comfort during use. The blanket (12) may be the size of conventional blankets, for example from 48 to 60 inches in width and from 60 to 72 inches in length.

The blanket (12) is preferably of a thickness (uncompressed) of from 0.1 to 0.4 inches, and more preferably from 0.2 to 0.3 inches for providing the desired level of comfort and softness. The blanket (12) is preferably made of a suitable flame/fire resistant material such as is commercially available from FAB Industries, Inc. Various fire resistant, flame retardant polyester fibers and polyester blankets are known, see for example Mizuno et al U.S. Pat. No. 4,222,926 issued Sept. 16, 1980, Romaine U.S. Pat. No. 4,624,320 issued Nov. 25, 1986, and Rohringer et al U.S. Pat. No. 4,116,702 all of which are incorporated herein by reference.

The pocket (14) is preferably made by attaching a cloth panel (22) to a central end portion (24) of the blanket (12). The panel (22) is preferably rectangular in shape and is attached (such as by stitching (36)) to the blanket (12) along three sides (26, 28, 30) of the panel (22), and is unattached at the remaining side (32) such that the pocket is open toward the center of the blanket when the comfort system (10) is in its unfolded position as shown in FIG. 1. The position of the pocket and the position of the open end of the panel allows the user (20) to place the user's feet (not shown) within the pocket (14) while the remainder of the blanket (12) is used by the user (20) to cover the upper portion of the user's body. The pocket (14) position and orientation also permit the blanket (12) to be easily and consistently folded into an effective pillow shape as shown in FIG. 5.

Figure 2:
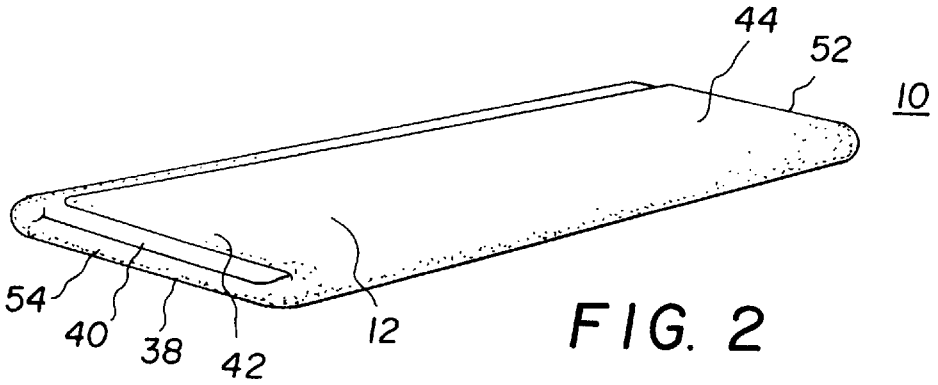
FIG. 2 is a perspective view of the comfort system in a partially folded position.
Figure 4:
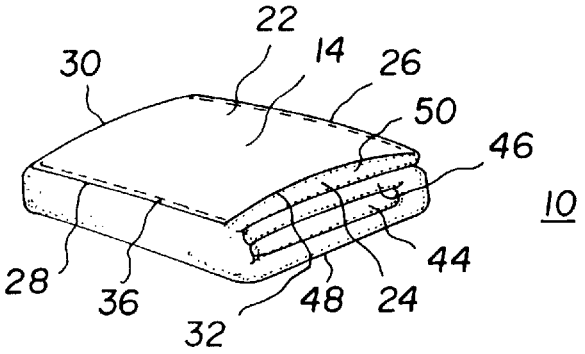
FIG. 4 is a perspective view of the comfort system in a third partially folded position.
Figure 6:
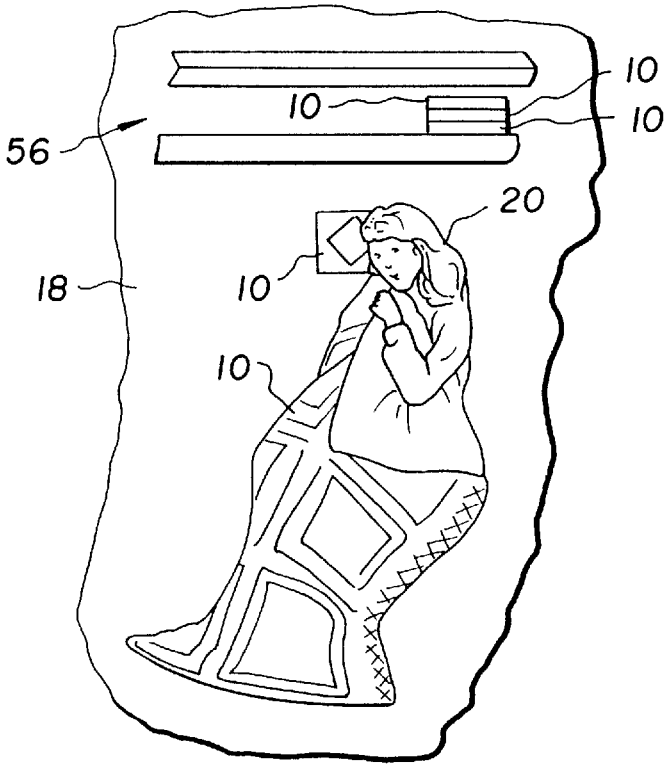
FIG. 6 is a cutaway interior view of an aircraft having the present comfort system.

The comfort system (comforter) (10) may be converted from an unfolded blanket configuration as shown in FIG. 1 to a folded pillow configuration as shown in FIG. 5 by the steps of (a) positioning the comforter (10) flat with the pocket on the underside of the comforter (10) (blanket (12)), (b) folding the comforter lengthwise into three substantially equal segments (portions) (38, 40, 42) with side portions (40, 42) being folded over middle portion (38) to create a three layer partially folded (elongated, narrow) configuration as best shown in FIG. 2; (c) folding (three folds, four substantially equal sized sections (44, 46, 48, 50)) the (narrow) partially folded configuration from an end (52) opposite the pocket (14) to an end (54) adjacent the pocket (14) (as shown in FIG. 4); and (d) turning (inverting, pulling) the pocket (14) over the sections (44, 46, 48, 50) to produce the desired pillow configuration as best shown in FIG. 5. As shown in FIG. 6, the comfort systems (10) may be stored in an overhead bin (56) of an aircraft (18), and then when in use may be used as either a comforter or as a pillow. The user (20) of FIG. 6 has her feet positioned within the pocket for additional warmth and comfort. As shown in FIG. 6, the stored comfort systems utilize the space of an equivalent number of blankets, but provide the flexiblity of providing use as either the equivalent number of pillows or the equivalent number of blanket or a combination thereof.

Figure 3:
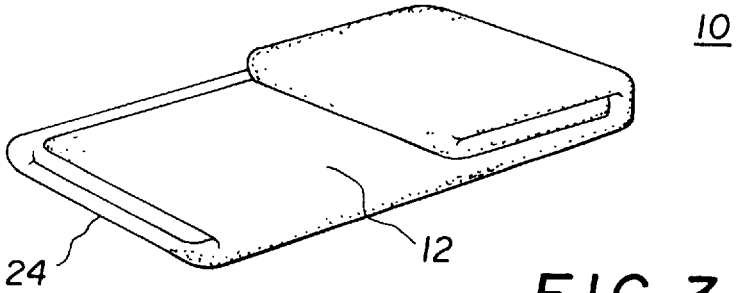
FIG. 3 is a perspective view of the comfort system in a second partially folded position.

The turning step results in the inside of the pocket (14) being turned to an exterior orientation (position) so that desired indicia (16) (such as advertising) is exposed to the user. This feature is especially attractive to the airline industry where premium gifts for first class passengers (20)

is desired, allowing the airline to promote its services. The structural relationship between the indicia and the pocket permits its selective exposure upon use of the comfort system so that during use at the users home the advertising is not distractive (inconsistent with the home atmosphere), but during storage the advertising is prominently displayed. FIG. 5 shows the orientation of the system during storage and/or configuration as a pillow. FIG. 3 shows the comforter in a partially folded position having had the lengthwise folds made and two of the three widthwise folds made. FIG. 4 shows the comforter with the two lengthwise folds having been made followed by the three widthwise folds having been made.

FIG. 6 shows the compact storage nature of the comfort system and its selective use as a pillow or a comforter. The selective use allows the airline to minimize the total number to units carried due to the comfort system being useful as either a pillow or a comforter.

Figure 7:
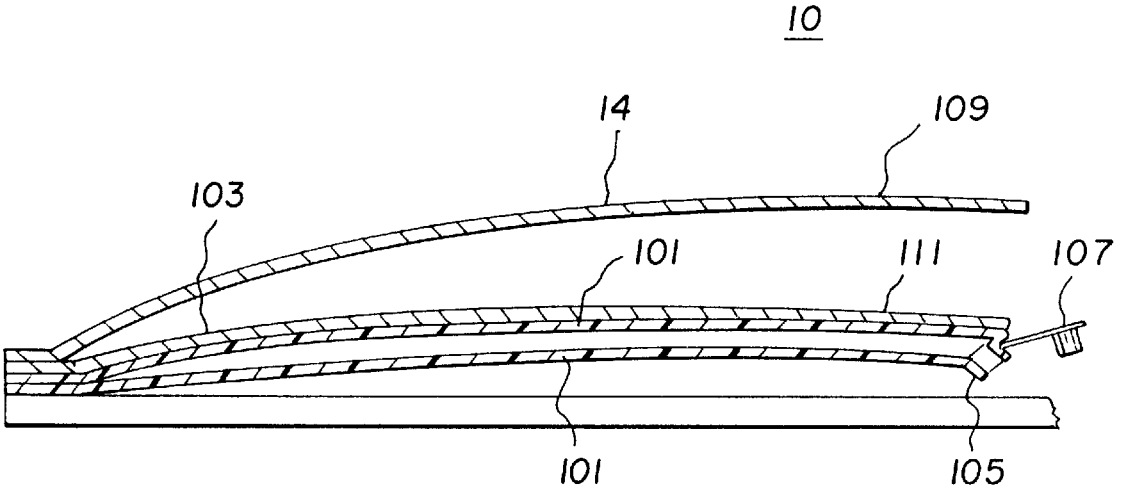
FIG. 7 is a vertical cross-sectional cutaway view of a comfort system having an inflatable pillow element in a pocket.

As best shown in FIG. 7, the comfort systmem (10) has an inflatable pillow element (101) positioned within (hidden in) the pocket (14) for permitting the user to inflate the pillow element (101) when the comfort system is unfolded. The pocket (14) comprises an inner pocket (103) in which the pillow element (101) is positioned. The inner pocket (103) serves to permit the pillow element (101) to be hidden from view and to be covered by soft blanket type material (fabric) when the comforter system is in either its folded or unfolded position. The pillow element is preferably made of an air impermeable (inflatable) plastic material such as that used in inflatable plastic items such as air matresses. The pillow element as an air tube (105) for permitting atmospheric air to be forced into the pillow element by conventional means such as a pump or by lung pressure. Air tube (105) has a cap (107) which allows the user to seal the pillow element after inflation and allows the user to deflate the pillow element of storage. The unique dual pocket arrangement provides for adequate pocket space for pillow element inflation and then after deflation for folding of the comforter into its folded position and without the visually undesirable exposure of the pillow element. The pillow element is preferably rectangular (square) in shape in substantial the size of the pocket (14). The pillow element may be secured to the pockets by stiching a perimeter (plastic lip) of the element to the adjacent fabric of the pockets.

A comforter system comprises(a) a blanket, (b) a pocket attached to the blanket, the pocket being positioned adjacent an end of the blanket and being open toward the center of the blanket when the blanket is an open position. The pocket comprises an outer pocket layer (109) and an inner pocket layer (111).

The system further comprises an inflatable pillow element secured to the inner pocket layer between the inner pocket layer and the blanket.

What is claimed is:

1. A comforter system comprising:

(a) a blanket;

(b) a pocket attached to said blanket, said pocket being positioned adjacent an end of said blanket and being open toward the center of said blanket when said blanket is in an open position, said pocket comprising an outer pocket layer and an inner pocket layer, and (c) an inflatable pillow element secured to said inner pocket layer between said inner pocket layer and said blanket, said blanket adapted to be folded and stored in said pocket.

2. The system of claim 1 wherein said pocket has a width of one third of the width of the blanket.

3. The system of claim 2 wherein said pocket has a length of one fourth of the length of the blanket.

4. The system of claim 1 wherein said pocket has indicia on the interior thereof.

5. The system of claim 1 wherein said comforter comprised a fire resistant material.

6. The system of claim 5 wherein said material is a polyester fibrous material.

7. A method for converting a comforter system having a pillow element and a comforter into a pillow, said method comprising:

(a) providing a blanket with an outer pocket positioned adjacent one end of said blanket and an inner pocket positioned within said outer pocket, said outer pocket having an opening, said inner pocket having an inflated pillow element positioned therein, (b) deflating said pillow element, (c) folding said blanket into sections, said sections being sufficiently small to be received by said outer pocket, and (d) turning said sections into said outer pocket by pulling said pocket over said sections to form the pillow having said pillow element covered by said a layer of said inner pocket.

8. The method of claim 7 wherein said pocket has indicia positioned so that the indicia is seen when said pillow is formed.

9. The method of claim 7 wherein said pocket has a size of one twelfth the size of the blanket based on the area of the blanket, said method comprising folding the blanket lengthwise with two folds and then folding the blanket widthwise with three folds.

* * * * *